US005456427A

United States Patent [19]

Greenhalgh

[11] Patent Number: 5,456,427

[45] Date of Patent: Oct. 10, 1995

[54] AIR-LAUNCHABLE GLIDING SONOBUOY

[75] Inventor: Samuel Greenhalgh, Doylestown, Pa.

[73] Assignee: The United States of America as represented by the Secretary of the Navy, Washington, D.C.

[21] Appl. No.: 281,807

[22] Filed: Jul. 25, 1994

[51] Int. Cl.[6] ..... B64D 1/02; B64D 1/12; F42B 10/02

[52] U.S. Cl. ..... 244/138 R; 244/137.1; 102/384; 89/1.51

[58] Field of Search ..... 244/137.1, 137.4, 244/138 R, 144, 147, 148, 149, 151 B; 102/384; 89/1.51, 1.54, 1.56, 1.57

[56] References Cited

U.S. PATENT DOCUMENTS

| | | | |
|---|---|---|---|
| 3,074,671 | 1/1963 | Dinolfo et al. | 244/138 |
| 3,229,290 | 1/1966 | Fisher | 244/98 |
| 3,464,652 | 9/1969 | Rogallo | 244/138 R |
| 3,874,325 | 4/1975 | Cocker, III | 244/98 |
| 4,209,151 | 6/1980 | Saunders | 244/138 R |
| 4,379,534 | 4/1983 | Miller et al. | 244/137.4 |
| 4,406,631 | 9/1983 | Dale | 244/138 R |
| 4,565,341 | 1/1986 | Zacharin | 244/138 R |
| 4,631,709 | 12/1986 | Bender et al. | 244/138 R |
| 4,696,443 | 9/1987 | Zacharin | 244/138 R |
| 4,856,737 | 8/1989 | Zacharin | 244/138 R |
| 5,042,744 | 8/1991 | Travor et al. | 244/3.29 |
| 5,052,270 | 10/1991 | Travor et al. | 89/1.51 |
| 5,063,823 | 11/1991 | Marshall et al. | 244/137.3 |
| 5,070,760 | 12/1991 | Marshall et al. | 244/137.4 |

*Primary Examiner*—David M. Mitchell
*Assistant Examiner*—Virna Lissi Mojica
*Attorney, Agent, or Firm*—James V. Tura; Susan E. Verona

[57] ABSTRACT

An air-launchable gliding sonobuoy store includes a canister enclosing an inflatable-membranous wing folded in a collapsed state with an electroacoustic system. After launching, the wing inflates and a steering mechanism controls the wing glide path by skewing the trailing edge thereof. Upon reaching the sea, the wing serves as a buoy with the electroacoustic system transducer depending therefrom.

9 Claims, 3 Drawing Sheets

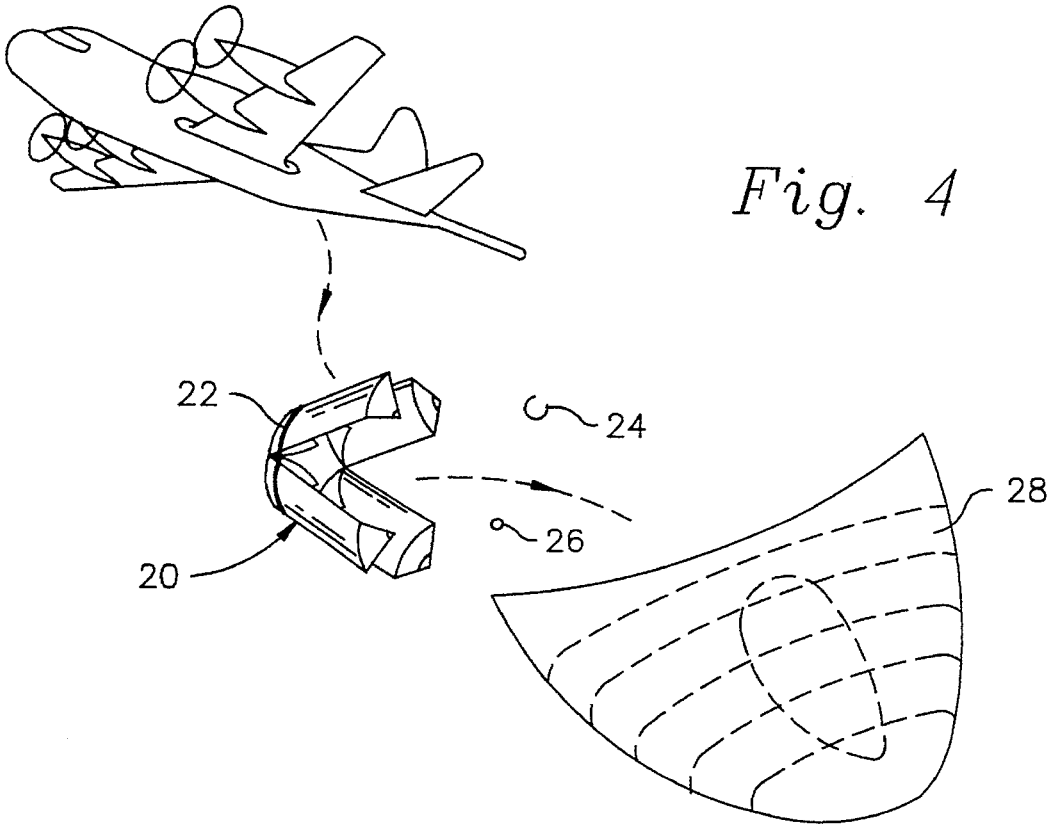
Fig. 4
Fig. 8
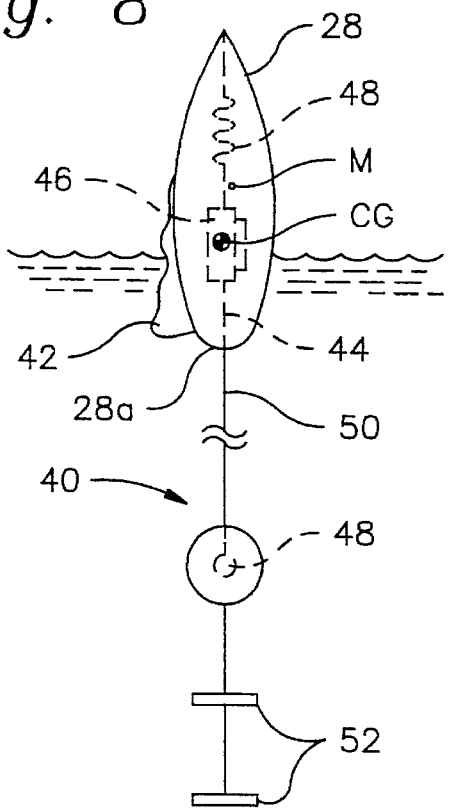
Fig. 9
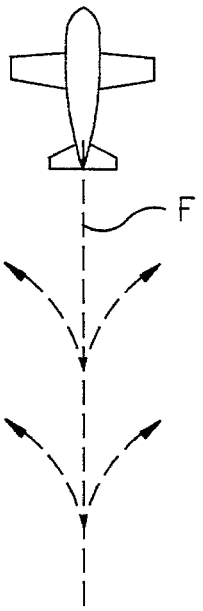

AIR-LAUNCHABLE GLIDING SONOBUOY

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

The present invention relates generally to air-launched stores, and more particularly to a gliding sonobuoy suitable for launching from an aircraft to diverse locations in the sea relative to the flight path.

Certain undersea detection and surveillance operations employ a long field of acoustic sensors created by launching a series of expendable sonobuoys at spaced intervals from an aircraft over a sea area of interest. The sonobuoys are typically ejected from launch tubes and retarded during descent by an air brake mechanism or drogue chute. As expected, the terminal positions of the sonobuoys are in a line generally parallel to the flight path of the aircraft except for slight deviations due to transitory changes in wind speed and direction. Sonobuoys retarded by air brakes will usually land in a narrow path close to the flight path, while sonobuoys with drogue chutes may drift with the air currents and land in a narrow path offset from the flight path.

In some surveillance missions, a relatively wide path of dispersion is desired. From an operational point of view, of course, it is advantageous to accomplish this in a single pass of the "seeding" aircraft. In addition to saving flight time and fuel consumption, the time required to lay out the array in proportion to the operational life-span of the sonobuoy is significantly reduced, and the accuracy of the dispersion pattern is improved since both local sea and atmospheric conditions have less time to influence the terminal position of each sonobuoy. To produce a wide dispersion path in a single pass, it is necessary for each sonobuoy to be guided to 15 the right or left of the aircraft's flight path as it descends. For example, U.S. Pat. No. 5,042,744 to Bruce W. Traver et al. discloses an air-launched store which has a collapsed cylindrical steering ring that expands around the small end of a truncated conical container after the store is ejected from a launch tube. The ring is angularly and longitudinally positioned relative to the container to provide aerodynamic stability and a predetermined direction of flight.

To operate as a radio-linked sonobuoy, the store must also have sufficient buoyancy when in the sea to support an antenna above the surface in order to transmit and receive. High sea states, in particular, require supplemental flotation in the sonobuoy, such as an inflated bag with an enclosed antenna, in order to ensure that the antenna stays above the surface for uninterrupted communications.

Heretofore, separate and discrete steering and flotation components have been utilized in air-launched sonobuoys to achieve both a wide field of dispersion in a single pass of the aircraft and sufficient buoyancy for uninterrupted transmission of radio signals after landing in the sea.

SUMMARY OF THE INVENTION

Accordingly, it is an object of the present invention to provide a low-cost air-launchable gliding sonobuoy store in which a single component provides both gliding to a desired location at sea and floatation after reaching the surface of the sea.

Another object is to provide an air-launchable inflatable wing having surfaces controllable for gliding along a desired flight path.

A further object is to provide an air-dropped store suitable for loading into an existing multi-store launch tube in an aircraft, and which deploys a wing for gliding along a predetermined flight path after ejection from the launch tube.

A still further object is to provide a dual-purpose wing for gliding in a predetermined flight path and for floating in a generally erect attitude in the sea.

Still another object is to provide an inflatable gliding buoy which can be packaged within a relatively small prelaunch configuration suitable for use in an existing multi-store launch tube, and which is relatively simple in design, reliable and inexpensive to manufacture.

These and other objects and aspects of an air-launchable gliding sonobuoy store according to the invention are achieved with an inflatable membranous wing folded in a collapsed state within a cylindrical canister of separable sections held together by a weak-link fastener. Several canisters may be stacked in a single launch tube and ejected sequentially. Upon leaving the launch tube, a condition-activated gas supply inflates the wing into a generally dihedral configuration as the force of the inflation breaks the weak-link fastener and jettisons the canister sections. A payload including a steering mechanism and a hydrophone suspension system in the wing provides a center of gravity located below and forward of the center of pressure for spontaneous orientation of the wing to a steady glide attitude. The steering mechanism controls left and right deviations from the glide path by skewing the wing's trailing edge. The center of gravity is also located below the metacenter of the wing and payload when floating with a trailing wing portion extending generally erect and above the surface. When a leading wing portion is immersed in the sea, an external pocket on the lower side of the wing opens to deploy the hydrophone suspension system. A sea-activated receiver/transmitter, and an antenna extended when the wing is inflated, provide a radio link between the hydrophone system and a remote station.

Other objects, novel features and advantages of the invention will become more apparent from the following detailed description taken in conjunction with the accompanying drawings wherein:

BRIEF DESCRIPTION OF THE DRAWINGS

FIG. 4 is a pictorial representation of the gliding sonobuoy store of FIG. 1 deployed in the air following ejection from the launch tube of FIG. 1;

FIG. 8 schematically illustrates a sonobuoy with a hydrophone suspension system according to the invention fully deployed in the sea from the store of FIG. 2; and FIG. 9 is a plan view illustrating a typical dispersion of a plurality of sonobuoys of FIG. 8 along the flight path of an aircraft; and

DESCRIPTION OF THE PREFERRED EMBODIMENT

Figure 1:
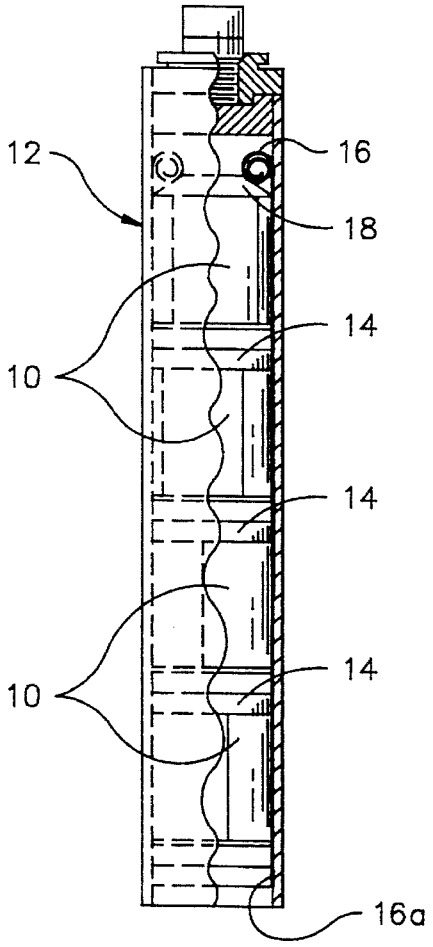
FIG. 1 is a longitudinal view, partially cut-away, of a multi-store launch tube containing a stack of gliding sonobuoys stores according to the present invention.

Referring now to the drawings wherein like referenced characters denote like or corresponding parts throughout the several views, FIG. 1 illustrates a plurality of gliding sonobuoy stores 10 loaded in a single multi-store launch tube 12 similar to one more fully described in U.S. patent application Ser. No. 07/544,295 now U.S. Pat. No. 5,052,270. Stores 10 are stacked end-to-end in the bore of tube 12 separated from each other by disk-shaped sabots 14 which secure each store 10 in position for serial ejection into the free airstream. Spiral springs 16 in the breach of tube 12 are preloaded by fixing outer ends 16*a* to the discharge end of tube 12 for exerting a relatively constant ejection force through a pusher plate 18 on the stores 10.

Figure 2:
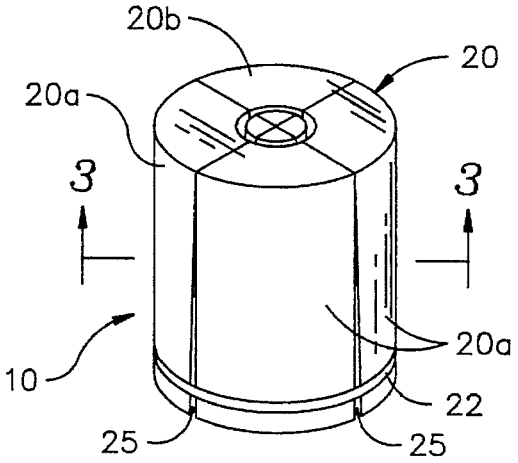
FIG. 2 is a perspective view of a gliding sonobuoy store of FIG. 1.
Figure 3:
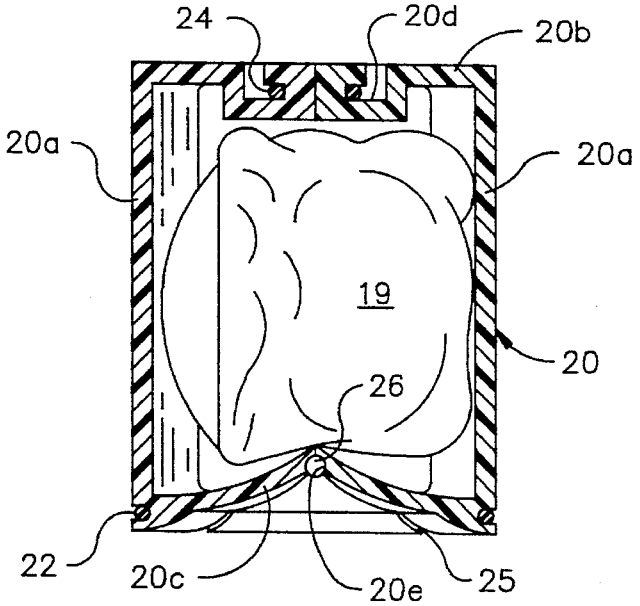
FIG. 3 is a view, partially in cross-section, of the gliding sonobuoy store taken in a longitudinal plane through the line 3—3 of FIG. 2.

Referring to FIGS. 2 and 3, each store 10 comprises an outer cylindrical canister 20 made up of four separable side-wall sections 20*a* with integral segments at opposite ends radially interfitting to form end-wall sections 20*b* and 20*c*. The sections are held together by an elastic O-ring 22 stretched around a groove in the periphery of end-wall 20*c*, and by a weak-link fastener 24 around a concentric groove 20*d* in end wall 20*b*. Side-wall sections 20*a* are tapered slightly inward near end-wall section 20*c* creating V-shaped gaps 25, and the segments of end-wall 20*c* converge to form a spherical cavity 20*e* for holding a ball bearing 26 inwardly offset from end wall 20*c* on the cylindrical axis of shell 20, whereby the hoop stress of O-ring 22 produces an opening moment of force about bearing 26 which is opposed by weak-link fastener 24.

Packaged within canister 20 is an inflatable membranous wing 28 initially folded in a collapsed state. Inflation is initiated by a condition-responsive gas pressure supply means 29 after ejecting from launch tube 12. The force of wing 28 expanding against the interior of sections 20*a* is sufficient to break weak-link fastener 24 and allow sections 20*a* to spread apart, as shown in FIG. 4. The moment of force by O-ring 22 about bearing 26 insures complete separation and jettisoning of canister 20 as wing 28 seeks a glide attitude.

Figure 5:
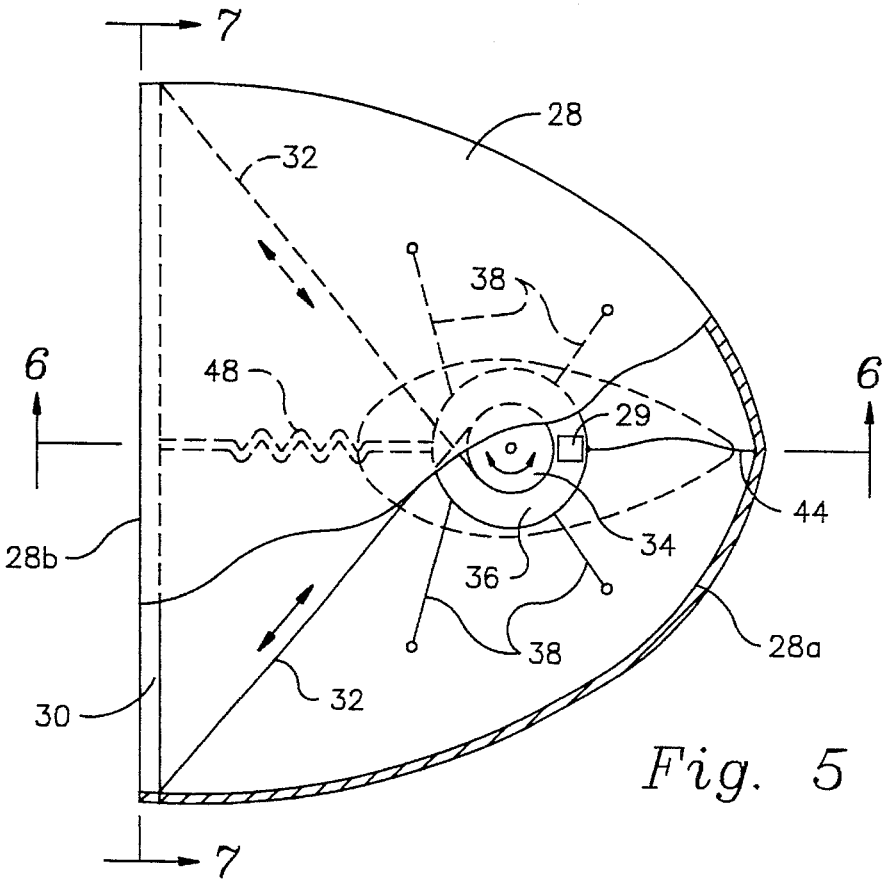
FIG. 5 is a partially cut-away plan view of a wing of the gliding sonobuoy store when fully inflated according to the invention.
Figure 6:
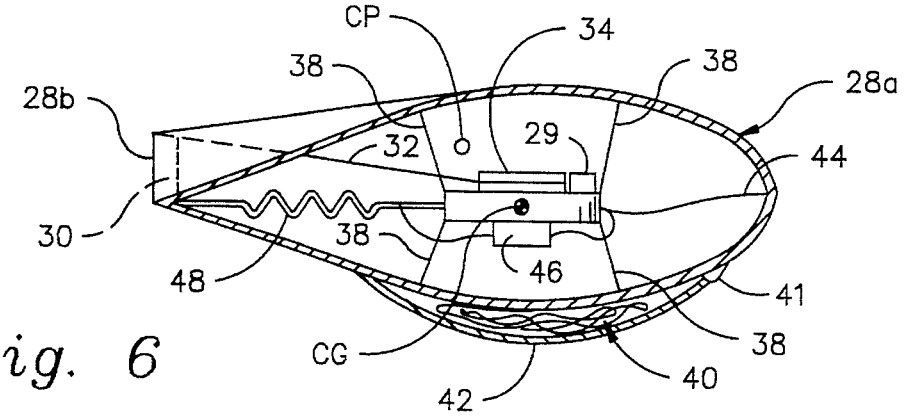
FIG. 6 is a cross-sectional view of the inflated wing taken along the line 6—6 of FIG. 5.
Figure 7:
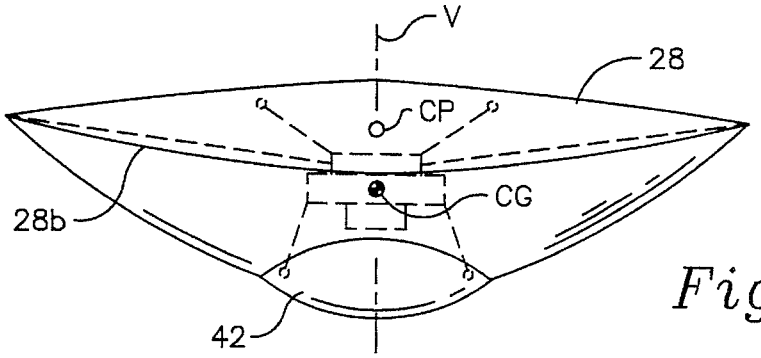
FIG. 7 is a rear view of the inflated wing taken along the line 7—7 of FIG. 5.

Referring now to FIGS. 5, 6 and 7, wing 28 is shown in a glide configuration fully inflated with a streamlined nose section 28*a* and sides spreading aftward to a transverse trailing edge 28*b*. Wing 28 is preferably constructed of lightweight, relatively inelastic membranous plastic capable of retaining its shape when fully inflated. A resilient stiffening rod 30 secured along the length of trailing edge 28*b* preferably inclines upward toward either end defining a dihedral-like configuration. The opposite ends of rod 30 are connected by steering cables 32 to a rotatable capstan 34 rotatable on a vertical axis fixed in suspension within wing 28 on a support member 36 by stays 38. Turning capstan 34 in either direction shortens one of cables 32 to skew trailing edge 28*b* and its adjacent control surfaces and causes wing 28 to bank right or left of a normally straight glide path. To insure wing 28 spontaneously assumes an upright attitude for gliding after being launched, it is essential that the center of gravity CG be located below and forward of the center of pressure CP as shown in FIG. 6, with both centers in the vertical plane of wing symmetry V as shown in FIG. 7. Other wing configurations are contemplated which may be preset to glide on diverse paths and provide a desired attitude for floatation in the sea.

The payload of wing 28 includes a hydrophone suspension system 40 carried in a separate streamlined pouch 42 on the lower side of wing 28. A condition-responsive sensor 41, such as an altimeter or sea water-activated device, opens pouch 42 allowing the suspension system 40 to deploy in the sea and energize a transmitter/receiver 46 mounted to support member 36. Suspension system 40 is electrically connected through a conductor 44 to a radio transmitter/receiver 46, and an antenna 48, the distal end of which is mechanically connected to stiffening rod 30 and automatically extended from support member 36 upon inflation of wing 28.

Referring to FIG. 8, wing 28 is shown in the floating configuration with the leading portion of wing 28 submerged and antenna 48 generally erect within the trailing portion exposed above the sea surface. The hydrophone suspension system 40 comprises a hydrophone 48, depending from nose section 28*a* by a signal transmitting cable 50, and dampened against vertical motion by a sea anchor 52.

Operation of the air-launched gliding sonobuoy is summarized as follows. For a given launch tube 12, each sonobuoys store 10 is assembled with capstan 34 set to skew the trailing edge 28*b* of wing 28 for a preselected right or left glide path, and then loaded with sabots 14 separating it from other stores in launch tube 12. The weak-link fastener 24 preferably faces inwardly to reduce any tendency for canister 20 to spread apart before store 10 is completely out of launch tube 12. Condition responsive device 29 then initiates inflation of wing 28. The force of the inflation breaks weak-link fastener 24 allowing sections 20*a* of canister 20 to separate, and antenna 48 becomes fully extended. The moment produced by O-ring 22 about bearing 26 further assures that the sections positively separate and jettison. When fully inflated into the dihedral-like configuration of wing 28, the location of the center of gravity relative to the center of pressure places the wing 28 in a steady glide attitude. The setting of capstan 34 determines the right or left glide path of each wing 28 to produce the desired dispersion along the aircraft flight path F as illustrated in FIG. 8.

When nose section 28*a* of wing 28 reaches the sea, hydrophone suspension system 40 is deployed and transmitter/receiver 46 energized for radio communication. In some applications the sonobuoy may include means for scuttling the sonobuoy after a preset duration.

Some of the many novel features and advantages of the invention should now be readily apparent. For example, an air-launched gliding sonobuoy store is provided in which an inflatable membranous wing provides both steering to a desired location and floatation after reaching the surface of the sea. The wing has preset controllable surfaces for achieving a desired flight path, and carries a sonobuoy deployable in the sea positioned for radio communication. The store is packaged into a small volume for loading in an existing multi-store launch tube of an aircraft, and the wing is deployed for gliding along a predetermined flight path after the store is ejected from the launch tube. The wing configuration serves plural functions: it glides into diverse places from stand-off distances, reduces the speed of descent and minimizes the kinetic energy on landing thereby cushioning and protecting its payload, floats when deployed in water, and disperses a group of sonobuoys over a wide area.

The invention is reliable and relatively simple in design, inexpensive to manufacture, and can be readily modified to meet requirements of other gliding buoy applications such as larger payloads, longer range and more accurate placement. For instance, much wider dispersion is possible with the addition of a simple electric propulsion motor.

It will be understood, of course, that changes in the details, steps and arrangement of parts which have been herein described and illustrated in order to explain the nature of the invention, may be made by those skilled in the art within the principle and scope of the invention as expressed in the appended claims.

I claim:

1. A gliding sonobuoy store dispensable from an airborne launch tube comprising, in combination:

a canister formed to be ejected from the launch tube, said canister having separable sections;

a membranous wing folded within said canister and inflatable into an aerodynamic stable configuration with a trailing edge;

a weak-link means securing said separable sections together and releasing said sections by the force imparted as said wing inflates;

inflator means carried by said wing for inflating said wing in response to a preselected condition after being ejected from the launch tube;

steering means carried by said wing for skewing said trailing edge for a desired glide path;

transducer means carried by said wing and deployable in suspension from said wing in the sea in response to a preselected condition; and electronic means carried by said wing for radio communicating signals between and said transducer means and a remote station.

2. A gliding sonobuoy store according to claim 1 wherein:

said wing includes a control surface defined by a nose section and opposed sides spreading afterward to said trailing edge forming thereby a dihedral.

3. A gliding sonobuoy store according to claim 2 wherein:

said separable sections form an annular recess; and said weak-link means includes an O-ring secured around said recess, said O-ring being broken by the inflation force of said wing.

4. A gliding sonobuoy store according to claim 1 wherein:

said inflator means includes a source of compressed gas, and initiating means for releasing the gas in response to said preselected condition.

5. A gliding sonobuoy store according to claim 1 wherein:

said wing includes a pouch retaining said transducer means while said wing is in a glide mode, and a condition responsive means for opening said pouch and releasing said transducer means for deployment in the sea.

6. A gliding sonobuoy according to claim 1 wherein:

said electronic means includes a transceiver for processing signals between said transducer means and the remote station, and an antenna erected between said transmitter and said trailing edge when said wing is inflated.

7. A gliding sonobuoy store according to claim 1 wherein:

the center of gravity of said wing is below and forward of the center of pressure of said wing.

8. A gliding sonobuoy store according to claim 1 wherein:

the center of gravity of the inflated wing is located below the metacenter thereof when said wing is floating in the sea with a trailing portion extending generally erect and above the surface.

9. A gliding buoy for dispensing from an elevated platform, comprising:

a container having an membranous wing folded therein and inflatable into an aerodynamically stable configuration with a trailing edge;

inflator means within Said wing for inflating said wing in response to a preselected condition upon dispensing from the platform; and steering means in said wing for skewing the trailing edge thereof for a desired glide path to the sea.

* * * * *